US008251833B2

(12) United States Patent
Georgescu

(10) Patent No.: US 8,251,833 B2
(45) Date of Patent: Aug. 28, 2012

(54) GOLF SWING-AID TRAINER, A DYNAMIC SWING AID DEVICE FOR IMPROVING THE GOLFER SWING ACTION

(75) Inventor: Florian Carol Georgescu, Shelby Township, MI (US)

(73) Assignee: Florian C. Georgescu, Shelby Township, MI (US)

( * ) Notice: Subject to any disclaimer, the term of this patent is extended or adjusted under 35 U.S.C. 154(b) by 0 days.

(21) Appl. No.: 12/927,772

(22) Filed: Nov. 22, 2010

(65) Prior Publication Data

US 2011/0136582 A1 Jun. 9, 2011

Related U.S. Application Data

(60) Provisional application No. 61/283,361, filed on Dec. 3, 2009.

(51) Int. Cl.
*A63B 69/36* (2006.01)

(52) U.S. Cl. ..... 473/212; 473/206; 473/227

(58) Field of Classification Search ..... 473/201, 473/212, 213, 219, 226, 227, 276
See application file for complete search history.

(56) References Cited

U.S. PATENT DOCUMENTS

| | | | | |
|---|---|---|---|---|
| 5,203,568 | A * | 4/1993 | Vasquez | 473/212 |
| 5,851,156 | A * | 12/1998 | Schwark, Jr. | 473/201 |
| 5,868,632 | A * | 2/1999 | Drelick | 473/213 |
| 5,976,024 | A * | 11/1999 | Marshall, Jr. | 473/227 |
| 6,350,206 | B1 * | 2/2002 | Lambert, II | 473/205 |
| 6,656,056 | B1 * | 12/2003 | Leonard | 473/227 |
| 6,719,639 | B2 * | 4/2004 | Novosel, Sr. | 473/213 |
| 2007/0149301 | A1 * | 6/2007 | Cox | 473/207 |

* cited by examiner

*Primary Examiner* — Nini Legesse

(57) ABSTRACT

A dynamic swing-aid device used to improve the golfer's swing action. It also reduces potential risk of swing injuries to golfers. The upper portion of this device is the wrist channel that fits over the forearm and allows the swing correction to occur. The lower part of the device is the handle guide that keeps the shaft of the golf club in the proper position with the clubface square to the target. This wrist swing-aid device is constructed of rigid material, and shaped to fit and support the club handle and to help the golfer's grip and swing motion. Its shape has a locating feature to lock in the top of club's handle. The sponge padded wrist channel has a self-adjusting feature to accommodate player's forearm size. The wrist channel upper portion may rest against the leading forearm to maintain a consistent swing motion and prevent wrist-hinging action during the club swing.

20 Claims, 5 Drawing Sheets

GOLF SWING-AID TRAINER, A DYNAMIC SWING AID DEVICE FOR IMPROVING THE GOLFER SWING ACTION

RELATIONSHIP TO PRIOR INVENTION

This invention bears a distinct relationship to my Provisional Patent application "Golf swing-aid" application No. 61/283,361, filed Dec. 3, 2009. This current patent application has some minor improvements related to the above-mentioned Provisional Patent. The teachings of both inventions and the respective patent applications are hereby incorporated by reference into this instant case.

BACKGROUND OF THE INVENTION

Golf is not an easy sport to play and master. It takes a lot of practice, patience and willing to spend time and money to learn the basics. Doing all of that, there are still no guarantees that you will not get frustrated with your golf game. It could also be a very expensive habit.

In the past many swing aid devices have been invented for use by golfers to aid them in developing and improving their swings and prevent injuries. Regrettably, most of the prior training aid devices concerned with the swing of the club have been expensive to buy and not easy to use. As a result, only a few of these devices have been embraced by golfers.

The ideal swing aid would assist a player training to achieve the proper club face motion throughout the back-swing and through-swing in maintaining proper position of both hands including the leading wrist to precisely address the ball target area. By achieving the exact rotation and the proper hand positions the golf club would supremely stay on its correct swing plane enabling the golf player achieve a well-executed shot.

Regarding some of the relevant prior art, the field of golf accessories is a growing field. One category within then the field of golf accessories is the category of swing training devices. Many golfers desire to improve their golf swing. Many different golf swing-training devices have been developed and are available to help golfers with their swing.

A first known device is U.S. Pat. No. 6,881,155 B2 to Rohan-Weaver describes a dynamic golf swing trainer device which provides an apparatus of anon-complex construction featuring full swing positions, usable in training a player in achieving correct club face rotation throughout the back swing and through swing. The "U" shaped portion rests against the leading forearm to assure proper wrist action of the clubface presentation.

U.S. Pat. No. 6,004,221 in which is described a device that attaches to a golf club shaft or grip and has contact bars who's upper ends contact the forearms.

Another known device is publication No. US2006/0154738 A1 in which bands are used to assist the user in training the muscles to perform a proper golf swing. This device claims proper separation of elbows.

Other known devices are shown in, U.S. Pat. No. 7,056,222 B2 to Skelley discloses a device and method for practicing a golf swing.

U.S. Pat. No. 6,416,419 B1 to Foresi discloses a golf swing trainer/exerciser apparatus that contacts the golfer during an improper swing.

U.S. Pat. No. 5,145,19 to Breed discloses a golf-training device that adjustably spaces the arms with a brace like device that makes no contact with the golf club.

U.S. Pat. No. 5,976,024 to Marshall discloses a golf swing enhancing apparatus that has two L-shaped arms that attach to a collar and make contact with the golfer's arms.

U.S. Pat. No. 6,283,874 to Studebaker discloses a golf club having a curved portion that fits under the golfer's underarm. U.S. Pat. No. 5,997,408 to Bankhead discloses a golf training aid for chipping and putting. U.S. Pub. No. 2008/0015041 A1 to Ryan discloses a bifurcated training apparatus for golf swing.

U.S. Pat. No. 4,023,812 to Lorang discloses a golf swing wrist action training device that comprises a leg that touches the golfer's hand or wrist and causes a click during a simulator golf swing to indicate the golfer has fully cocked his wrists.

Although the prior art can assist the player in golfing, the present inventors are unaware of a single, easy to use, portable, lightweight, unique device that can help the golfer in all aspects of golfing. Accordingly, there is need for a swing device that can be used to assist the golfer in learning the fundamentals of the golf swing tempo, using a practical swing aid device.

SUMMARY OF THE INVENTION

In accordance with the ideas of the present invention, the portable swing-aid disclosed here trains a player to correct his/her golf swing action and improve the handicap score. The swing-aid includes a device that comes in contact with the club handle and is attached to the golfer's forearm.

It is a non-handed device, which allows both right and left-handed golfers to use the same apparatus. This novel device is an upward extension to the club handle guide and fits over the player's forearm. It links the player's hands to the leading forearm like a brace. The upper sector of the device, the wrist channel is fitted over the player's forearm and the lower sector, the handle guide rests in the player's hand, where the upper section wraps the forearm. The golfer grabs the club handle, and gets into address position stance ready to swing and drive the ball. The devices handle guide rests under of the club handle, and is sandwiched between the club handle and the golfer's wrapped fingers. The device supports the arm wrist and prevents it from hinging during the golfer swing action; improving golfer through swing consistency and maintaining the clubface square to the target.

My unique device is intended for use of all players, it is a universal wrist swing aid device.

In designing my golf swing-aid device I was well aware of the fact that many players tend to develop bad swing habits. This device is intended to teach golfers how to apply the swing fundamentals and succeed in striking the ball without excessive routine preparation.

It is one of my goals as part of the present invention is to provide an easy and simple construction, useful in aiding a player in achieving the swing dynamics throughout the back swing, down swing and through swing motion. As a result of its unique design a proper forearm rotation with the leading wrist in correct position maintaining a square clubface to the ball target area.

My dynamic swing-aid was configured to force the player to maintain his of hers hands, forearms, shoulders and body hips in a desirable and efficient position during the entire club swing. The golf club must be properly aligned which means the clubface is square to the target.

My portable golf swing-aid instructor I have developed is preferably manufactured from a single piece of stiff material that has been shaped into curvatures and straight sectors designed to provide suitable leading wrist and forearm adjustable contact and support and enable the golfer to attain the proper golf swing pose and ultimately improve the success of hitting the ball.

Another novel feature of my golf swing-aid is the deliberate upper shaped wrist channel, which permits adjustments from narrow to wider to accommodate golfer's forearm size.

It is another principal objective of this invention to provide a golf swing aid cheap to be made and affordable, with no additional attachments to the golf club, and highly effective in helping a beginner or intermediate golfer develop a correct golf swing.

Another objective of my invention is to calibrate a golfer's club upward swing action which puts a player at high risk of an excessive body twist condition and thus preventing golf swing injuries. This is accomplished when the device is worn on the leading forearm.

These and other objective, features and advantages of my golf swing aid will turn out to be more significant as the drawing and detail descriptions continue.

DETAILED DESCRIPTION OF THE PREFERRED EMBODIMENTS

My invention, the golf swing-aid trainer which is a dynamic swing aid device for improving the golfer swing tempo action while maintaining his or hers wrists in the correct position throughout the swing action.

Figure 1:
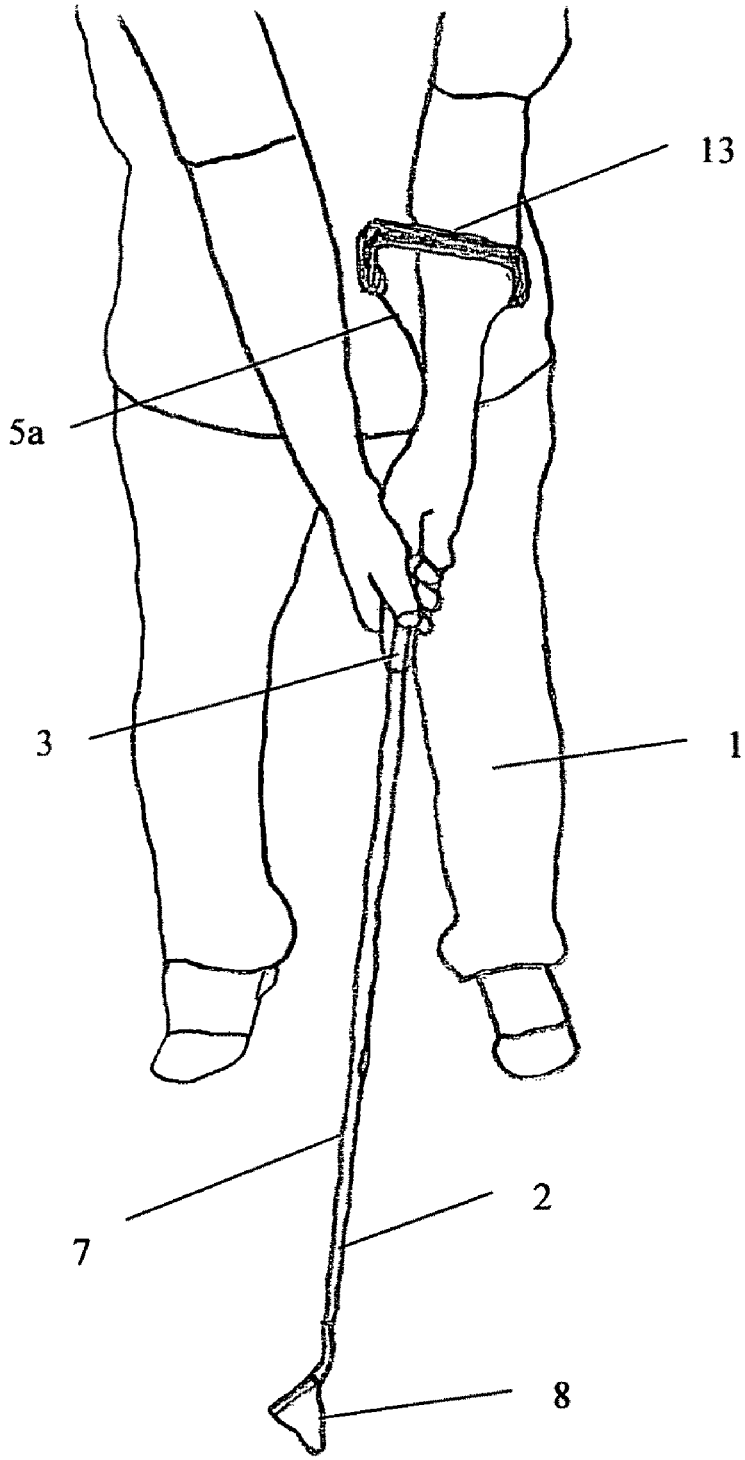
FIG. 1 is a view of my golf swing-aid trainer, a dynamic swing aid device to help improving the golfer swing tempo action, concurrently addressing the target area.

An example of my invention is illustrated in the FIG. 1 where a golfer 1 properly using a golf club 2 will grip the handle on the club 2 with the forearms in a "V" formation as shown in FIG. 1 on the handle grip 3 and where the player assumes the addressed stance position.

Figure 2:
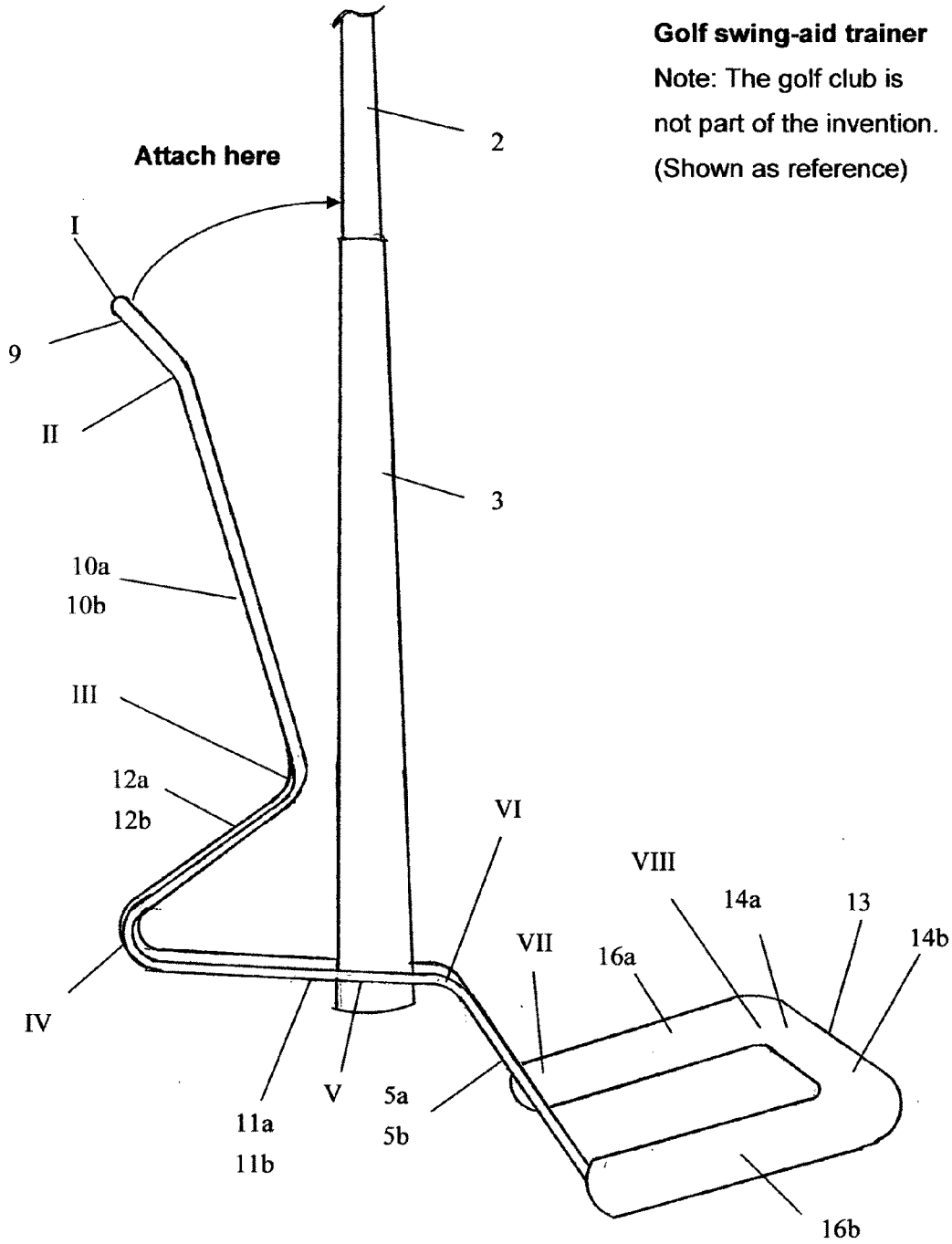
FIG. 2 is a close-up view of the side profile of my invention. The view reveals the eight profile bends with the various sectors that are successfully brought into contact with the golfer's left forearm of a right handed player during his or hers swing action of the club to ensure the proper wrist position and the swing tempo necessary to perform.

As seen in this figure as well as in FIG. 2 the swing aid trainer 1 involves my dynamic swing-aid handle guide Sections 9, 10, 11 and 12 to which the club handle 3 is attached in position. The guide sectors 9, 10, 11 and 12 with the forearm channel sectors 5, 16 and 14 are constructed essentially of a single piece of bent rigid material. It is understood that the golf club 2 and its head 8 is not part of this invention and is intended to provide visual reference for the entire assembly between the golf club and my dynamic swing-aid trainer device while attached to the player's forearm. The swing-aid handle guide portion is configured to comfortably receive the hands of the golfer in a desirable orientation in relationship to the club head 8. During a golf swing, this position is maintained by the force applied by the wrist channel sectors 13, 14 and 16 against the golfer's leading forearm. An equal but opposite force applied between the golf club 2 and the left hand 3 as is shown in FIG. 2 for the right hand player. Also the force is transmitted through 5*a* and 5*b* in order to keep proper position of the club face 8 throughout the swing. This device transfers the maximum force from the player forearms through the shaft 7 and to the club face 8.

The golf swing-aid invention has a handle guide part comprised of five sectors, and a shaped wrist channel that is used to improve the golfer's swing tempo action and to promote a repetitive and consistent swing of the club. The front of the handle guide 9 and the hilt sector 12 of the device are spaced to only accommodate the proper grip of the club with both hands. The wrist channel sectors 14 and 16 are located at the upper end of the device and apply the corrective action throughout the swing motion. The wrist channel has a sleeve 13, which fits over the sectors 14 and 16 and is made out of soft material to cushion the contact with the golfer's forearm. Inside the sleeve tube are two active sectors 14*a* and 14*b* moving toward each other, which allow the adjustment of the channel opening to accommodate a player's forearm size.

Continuing now with primary reference to FIG. 2 it will be noted that the novel device has eight bends each at a preferred angle which serve to define the different sectors or portions I through VIII. The device guide portions 11*a* and 11*b* have a quarter moon indentation feature V, on the opposing sides that could optionally lock-on lock the end of the club handle as shown in View A of FIG. 6.

As noted in FIG. 2, portion 9 has an angle of 20 deg down bend I which forms the tip of the guide. This first bend I is in direct contact with the club handle 3. The middle of the guide construction Sectors 10 and 12 are significant in positioning the club handle 3 into the guide, assuring the handle grip contact and also permitting proper location of the index finger. The end of the club handle 3 could be locked on position by the sectors of the guide 11*a*, 11*b* and the quarter moon sector bends V. This guide feature is offered as a choice feature to the golfer 1. The third bend portion III has a down bend angle of 120 deg. This sector bend III continues with rear sectors 12*a*, 12*b*. The next bend IV has up bend angle of 60 deg and continues with portions 11*a* and 11*b* and the lock in feature V. These important design features provide a significant connection and support to the club handle grip. The guide sectors 12*a*, 12*b*, 11*a* and 11*b* formed a "V" shape. The next sector bend VI forms an angle of 120 deg in reference to portions 11*a* and 11*b*. The upper guide sectors are 5*a* and 5*b*, left and right, and both each sectors have an open angle of 45 deg in plan view. A relatively up bend Sector VII of 120 deg continues with Portions 16*a* and 16*b*. These sectors are linked to form the shaped channel represented by sectors 16*a*, 16*b*, 14*a* and 14*b*. The final bend sector VIII is at an angle of 90 deg and finishes with portions 14*a* and 14*b*. The wrist channel has a soft rubber sleeve 13 which come in contact with the player's forearm only when the club and the swing aid guide are in the follow through position. It is to be noted that the rubber sleeve channel 13, which covers Sectors 16*a*, 16*b*, 14*a*, 14*b*, is in permanent contact with the leading forearm of golfer when the club is moving upward in what is known as the take away position. The two sectors 14*a* and 14*b* are flexible and adjustable to accommodate player's forearm. The wrist channel opening size is adjustable at the top where upper sectors

14*a* and 14*b* could slide against each other to vary the ring size. The rubber sleeve inside diameter allows the portions 14*a* and 14*b* to slide against one another.

Preferred construction of my golf swing-aid from a single piece of metal material bend to shape as described in this paper, such as 3/16" Dia. stainless steel rod or low carbon cold roll steel rod, to give the invention strength and flexibility. Back to a consideration of my golf swing-aid trainer device is to be understood that wrist channel sector 13 is in successively in contact with the left forearm of the right hand player at entirely different times during the club swing.

It is very important to know that any prior art devices in this category intended to correct and control the wrist positions during the swing of the club failed short of maintaining the golfer's ability to control the proper swing plane and the club face square position throughout the impact. My novel device permits a golfer to select which of the two forearms to use whether the player is a right handed or left handed. For a short distance using the irons like pitching and chipping are recommended with the device attached to the leading forearm.

Another advantage of my novel invention is that my device is made of one single piece of material with a rubber sleeve which partially covers only the wrist channel section which wraps around and come in contact with the golfer's leading forearm.

Figure 3:
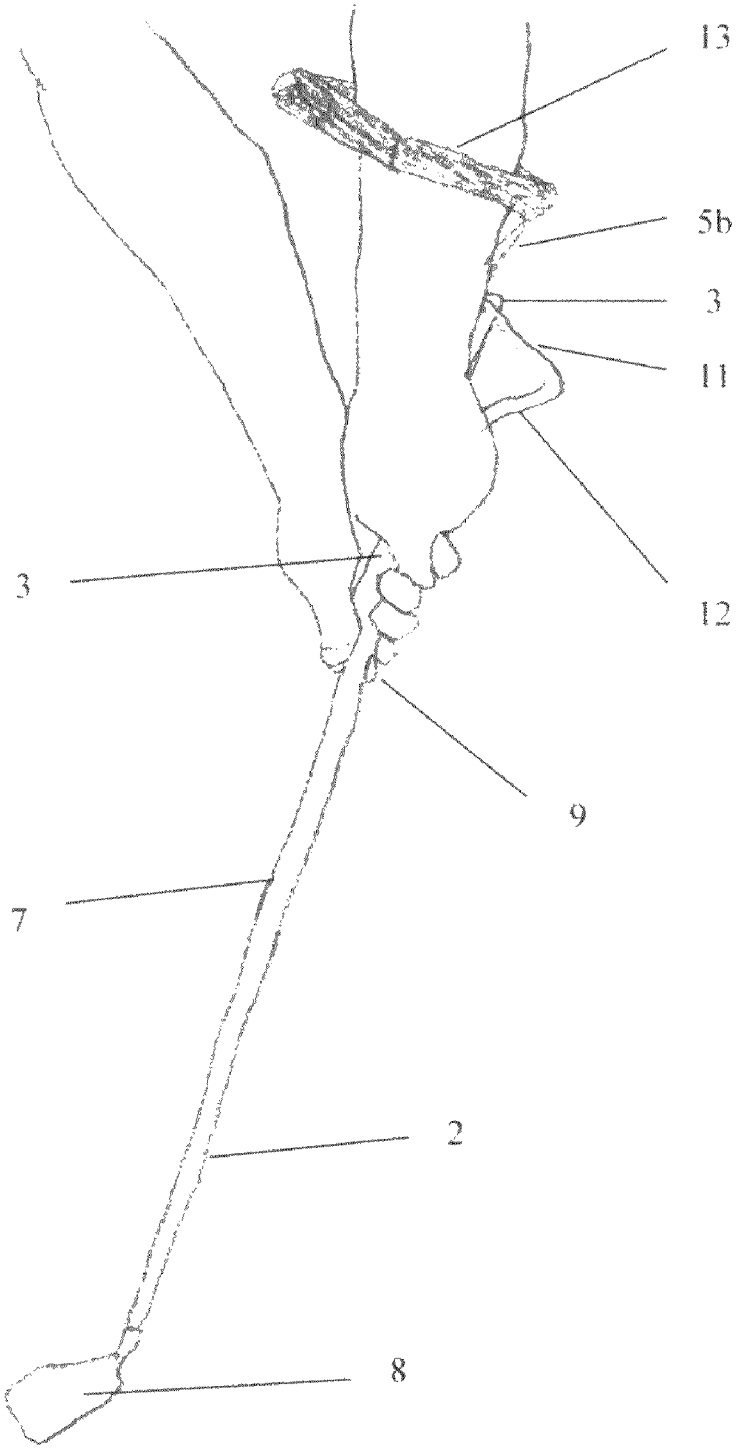
FIG. 3 is a front view of the relationship between my upper portions of my training aid to a right-handed golfer's forearm at the time the player is holding the device in the correct stance position addressing the ball.

FIG. 3 represents the partial view of golfer who holds my training device in the address position. The wrist channel portion 13 wraps around golfer's forearm maintaining a contact with it. Visible in this view are certain other call outs like the club's face 8 and the player's handle grip 3.

Figure 4:
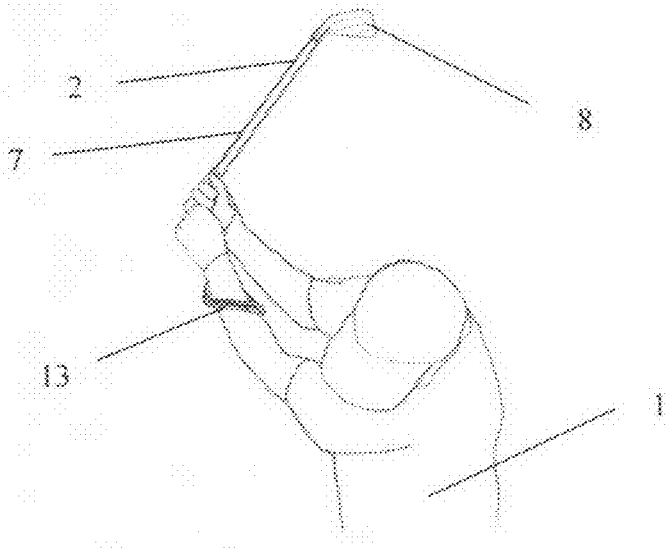
FIG. 4 is a view of my invention device showing the relationship of the wrist swing-aid wrist channel portion 13 to the player's forearm in the upswing position with the club.

FIG. 4 shows the player has moved my swing-aid training device to position near the top of the back swing, at which time Sector 13 of the wrist channel is in contact with the player left forearm with the wrist in a neutral position.

Figure 5:
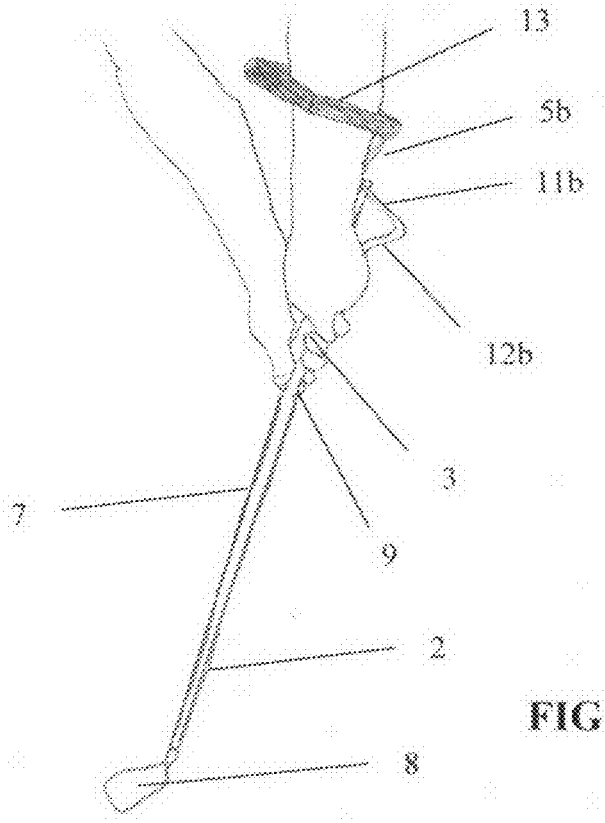
FIG. 5 is a view of my training device with regard to the relationship of the upper portion of the device attached to the forearm of the golfer when the square face of the club's head strikes the ball.

With the reference to FIG. 5 this portrays the golfer in attended position with my device attached to his forearm and being ready to strike to ball. The rubber sleeve Section 13 is wrapped around his forearm, the handle guide sectors maintain the club handle locked and the clubface square to the target during the ball impact.

Figure 6:
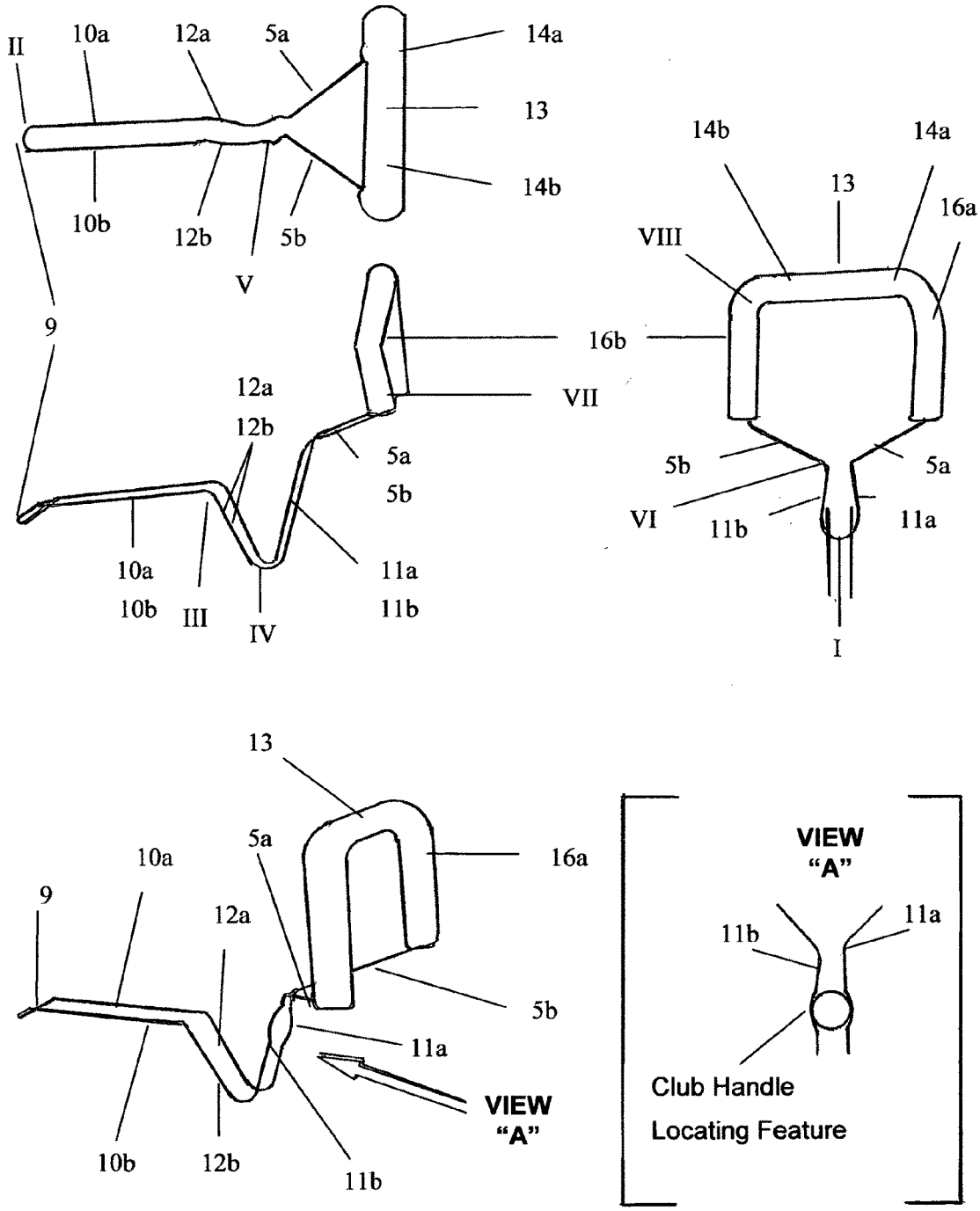
FIG. 6 is a close-up detailed view of my invention representing approximately what a golfer might see when looking at multiple views of the front, side, top and the isometric view of the device.

Another important aspect of my invention is shown in FIG. 6. It shows my novel invention in three standard views, the front, side, top, including an isometric and a detailed VIEW "A". This view shows the club handle locating feature 3, very useful in aligning the club.

I consider myself a casual golfer and I consistently use my dynamic wrist swing-aid to calibrate and improve my short distance game and avoid potential swing injuries.

I prefer to use this wrist swing aid that attaches to the forearm and keeps your clubface square to the target during and throughout golfer's swing motion. This device helps with my chip shots accuracy and swing tempo stability.

I strongly recommend it if you are an inexperienced golfer. You should practice and develop your golf swing tempo to best fit your body physical condition.

I claim:

1. A golf swing-aid for minimizing wrist-hinging and facilitating consistent swing motion during an individual's swing with a golf club, the golf swing-aid comprising:

a first portion having an elongated guide channel configured to accept a handle of the golf club and be gripped simultaneously with the handle by the individual's first hand;

a second portion connected to the first portion and having a locating feature configured to position a distal end of the club handle; and a third portion connected to the second portion and having a forearm channel configured to encircle and rest against the individual's first forearm;

wherein:

the first, second, and third portions together form a rigid structure; and the wrist of the first arm is supported to minimize wrist-hinging thereof and consistent motion during the individual's swing with the golf club is facilitated when the first forearm is inserted into and encircled by the forearm channel, the club handle is accepted by the guide channel, the distal end of the club handle is positioned by the locating feature, the first portion and the club handle are simultaneously gripped by the first hand, and the club is gripped by the individual's second hand.

2. The golf swing-aid of claim 1, wherein the size of the forearm channel is configured to adjust to fit the circumference of the first forearm.

3. The golf swing-aid of claim 1, wherein the first, second, and third portions form a monolithic structure.

4. The golf swing-aid of claim 3, wherein:

the structure includes a first free end and a second free end;

the forearm channel is defined by the first free end and the second free end; and the first and second free ends are configured to shift relative to one another when the first forearm is inserted into the forearm channel.

5. The golf swing-aid of claim 4, further comprising a soft section arranged on the forearm channel and configured to cover the first and second free ends.

6. The golf swing-aid of claim 5, wherein the soft section is a sleeve formed from a pliant material, and wherein the first and second free ends of the structure are inserted into the sleeve.

7. The golf swing-aid of claim 4, wherein the structure is formed from a composite material.

8. The golf swing-aid of claim 4, wherein the structure is a segment of steel wire.

9. The golf swing-aid of claim 8, wherein the segment of steel wire is covered with a coating to minimize corrosion.

10. The golf swing-aid of claim 1, wherein the locating feature of the second portion includes a lock-in feature configured to fix the distal end of the club handle.

11. A golf swing-aid for minimizing wrist-hinging and facilitating consistent swing motion during an individual's swing with a golf club, the golf swing-aid comprising:

a first portion having an elongated guide channel configured to accept a handle of the golf club and be gripped simultaneously with the handle by the individual's first hand;

a second portion connected to the first portion and having a locating feature configured to position a distal end of the club handle;

a third portion connected to the second portion and having a forearm channel configured to encircle the individual's first forearm; and a soft section arranged on the forearm channel and configured to rest against the individual's first forearm;

wherein:

the first, second, and third portions together form a rigid monolithic structure; and the wrist of the first arm is supported to minimize wrist-hinging thereof and consistent motion during the individual's swing with the golf club is facilitated when the first forearm is inserted into and encircled by the forearm channel, the club handle is accepted by the guide channel, the distal end of the club handle is positioned by the locating feature, the first portion and the club handle are simultaneously gripped by the first hand, and the club is gripped by the individual's second hand.

12. The golf swing-aid of claim 11, wherein the size of the forearm channel is configured to adjust to fit the circumference of the first forearm.

13. The golf swing-aid of claim 12, wherein:

the structure includes a first free end and a second free end;

the forearm channel is defined by the first free end and the second free end; and the first and second free ends are configured to shift relative to one another when the first forearm is inserted into the forearm channel.

14. The golf swing-aid of claim 13, wherein the soft section is a sleeve formed from a pliant material, and wherein the first and second free ends of the structure are inserted into the sleeve.

15. The golf swing-aid of claim 11, wherein the structure is formed from a composite material.

16. The golf swing-aid of claim 11, wherein the structure is a segment of steel wire.

17. The golf swing-aid of claim 16, wherein the segment of steel wire is covered with a coating to minimize corrosion.

18. The golf swing-aid of claim 11, wherein the locating feature of the second portion includes a lock-in feature configured to fix the distal end of the club handle.

19. A golf swing-aid for minimizing wrist-hinging and facilitating consistent swing motion during an individual's swing with a golf club, the golf swing-aid comprising:

a first portion having an elongated guide channel configured to accept a handle of the golf club and be gripped simultaneously with the handle by the individual's first hand;

a second portion connected to the first portion and having a lock-in feature configured to fix the distal end of the club handle;

a third portion connected to the second portion and having a forearm channel configured to encircle the individual's first forearm; and a soft section arranged on the forearm channel and configured to rest against the first forearm;

wherein:

the first, second, and third portions are formed from a segment of steel wire covered with a coating to minimize corrosion;

the size of the forearm channel is configured to adjust to fit the circumference of the first forearm; and the wrist of the first arm is supported to minimize wrist-hinging thereof and consistent motion during the individual's swing with the golf club is facilitated when the first forearm is inserted into and encircled by the forearm channel, the club handle is accepted by the guide channel, the distal end of the club handle is positioned by the locating feature, the first portion and the club handle are simultaneously gripped by the first hand, and the club is gripped by the individual's second hand.

20. The golf swing-aid of claim 19, wherein:

the structure includes a first free end and a second free end;

the forearm channel is defined by the first free end and the second free end;

the first and second free ends are configured to shift relative to one another when the first forearm is inserted into the forearm channel; and the soft section is a sleeve formed from a pliant material, and wherein the first and second free ends of the structure are inserted into the sleeve.

* * * * *